US011269365B2

(12) United States Patent
Murakami

(10) Patent No.: US 11,269,365 B2
(45) Date of Patent: Mar. 8, 2022

(54) VOLTAGE-GENERATING CIRCUIT AND SEMICONDUCTOR DEVICE USING THE SAME

(71) Applicant: Winbond Electronics Corp., Taichung (TW)

(72) Inventor: Hiroki Murakami, Yokohama (JP)

(73) Assignee: WINBOND ELECTRONICS CORP., Taichung (TW)

( * ) Notice: Subject to any disclaimer, the term of this patent is extended or adjusted under 35 U.S.C. 154(b) by 0 days.

(21) Appl. No.: 16/952,873

(22) Filed: Nov. 19, 2020

(65) Prior Publication Data

US 2021/0157348 A1 May 27, 2021

(30) Foreign Application Priority Data

Nov. 21, 2019 (JP) ..... JP2019-210096

(51) Int. Cl.
*G05F 1/46* (2006.01)
*G05F 3/24* (2006.01)
*G05F 1/567* (2006.01)

(52) U.S. Cl.
CPC ..... *G05F 1/468* (2013.01); *G05F 1/567* (2013.01); *G05F 3/245* (2013.01)

(58) Field of Classification Search
CPC ..... G05F 1/468; G05F 1/567; G05F 3/245
USPC ..... 323/313
See application file for complete search history.

(56) References Cited

U.S. PATENT DOCUMENTS 6,111,397 A * 8/2000 Leung ..... G05F 3/245 323/312
9,846,446 B2 * 12/2017 Choi ..... G05F 3/267
11,012,067 B2 * 5/2021 Ruffieux ..... H03K 19/00384
2006/0285408 A1 * 12/2006 Betser ..... G11C 16/3404 365/212

(Continued)

FOREIGN PATENT DOCUMENTS

CN 105807838 A 7/2016
JP 59-135520 A 8/1984

(Continued)

OTHER PUBLICATIONS

Japanese Office Action for Japanese Application No. 2019-210096, dated Dec. 9, 2020, with an English translation.

*Primary Examiner* — Yemane Mehari
(74) *Attorney, Agent, or Firm* — Birch, Stewart, Kolasch & Birch, LLP

(57) ABSTRACT

The invention provides a voltage-generating circuit with a simple configuration capable of saving space and generating reliable voltage. The voltage-generating circuit of the invention includes a reference voltage-generating unit, a PTAT voltage-generating unit, a comparison unit, and a selection unit. The reference voltage-generating unit generates a reference voltage essentially without dependency on temperature. The PTAT voltage-generating unit generates a temperature-dependent voltage with a positive or negative dependency on temperature. The temperature-dependent voltage is equal to the reference voltage at a target temperature. The comparison unit compares the reference voltage with the temperature-dependent voltage. The selection unit selects and outputs either the reference voltage or the temperature-dependent voltage.

20 Claims, 8 Drawing Sheets

(56) References Cited

U.S. PATENT DOCUMENTS

2021/0351771 A1* 11/2021 Arakawa ..... H03F 3/217

FOREIGN PATENT DOCUMENTS

| | | | |
|---|---|---|---|
| JP | 2016-173869 | A | 9/2016 |
| TW | 201020710 | A1 | 6/2010 |

* cited by examiner

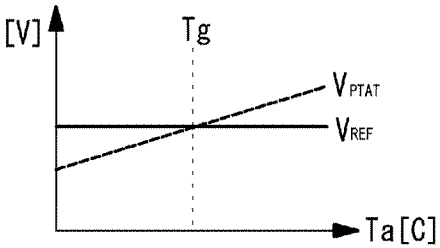
FIG. 4(A) input
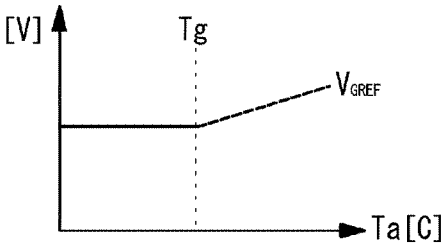
FIG. 4(A-1) output
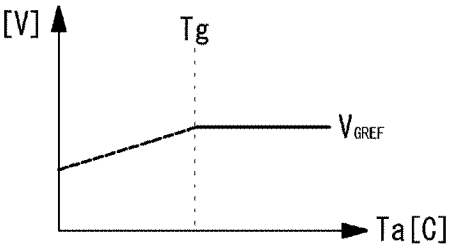
FIG. 4(A-2) output
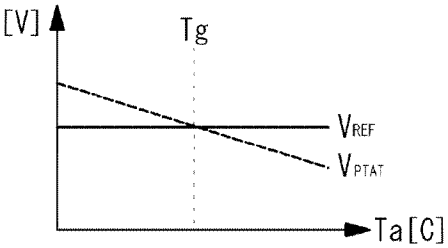
FIG. 4(B) input
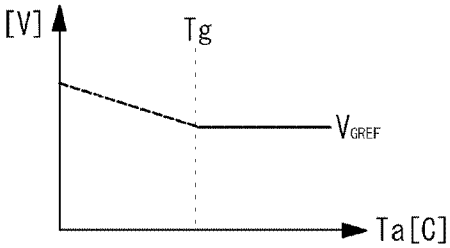
FIG. 4(B-1) output
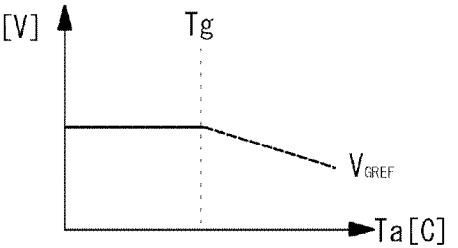
FIG. 4(B-2) output
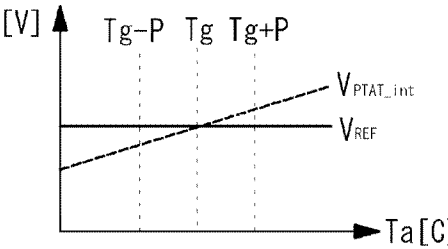
FIG. 4(C) DC offset adjustment:
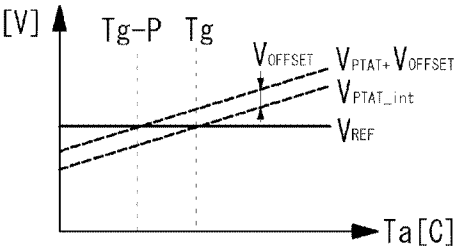
FIG. 4(C−1) target temperature Tg-P
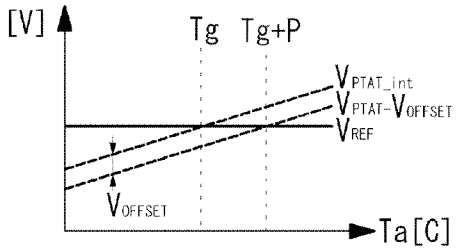
FIG. 4(C−2) target temperature Tg+P

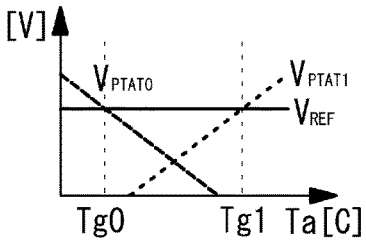
FIG. 7(A) input
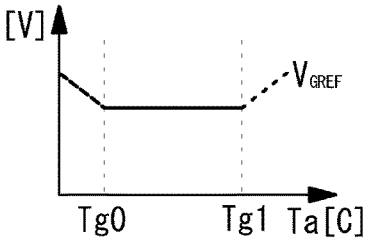
FIG. 7(A-1) output
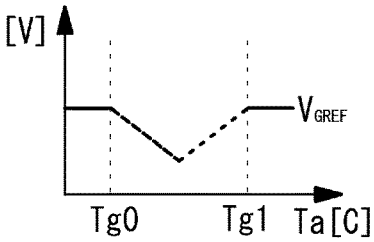
FIG. 7(A-2) output
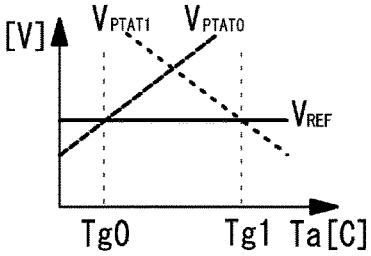
FIG. 7(B) input
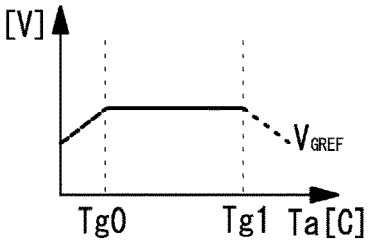
FIG. 7(B-1) output
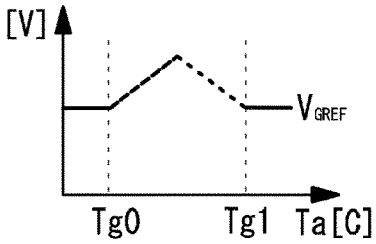
FIG. 7(B-2) output
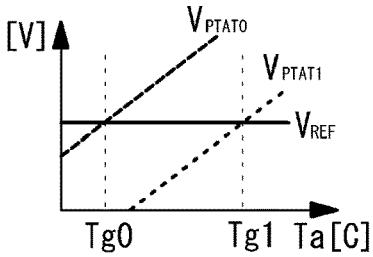
FIG. 7(C) input
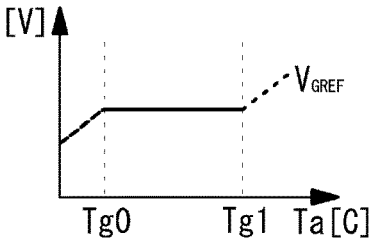
FIG. 7(C-1) output
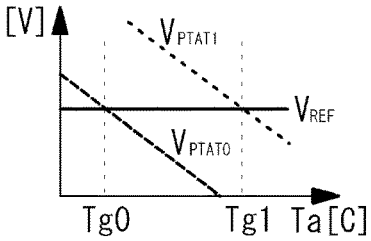
FIG. 7(D) input
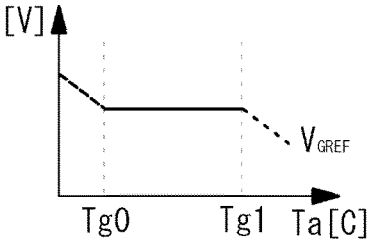
FIG. 7(D-1) output
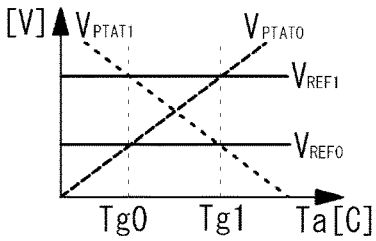
FIG. 7(E) input
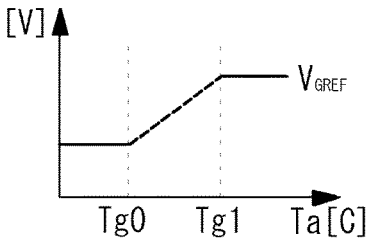
FIG. 7(E-1) output
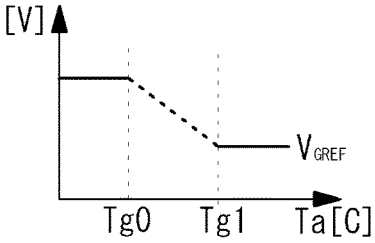
FIG. 7(E-2) output

VOLTAGE-GENERATING CIRCUIT AND SEMICONDUCTOR DEVICE USING THE SAME

CROSS REFERENCE TO RELATED APPLICATIONS

The present application is based on, and claims priority from, Japan Application Serial Number 2019-210096, filed on Nov. 21, 2019, the disclosure of which is hereby incorporated by reference herein in its entirety.

BACKGROUND OF THE INVENTION

Field of the Invention

The present invention relates to a voltage-generating circuit, and more particularly, to a voltage-generating circuit generating temperature-compensating reference voltage.

Description of the Related Art

In semiconductor devices such as memory or logic circuits, the reliability of the circuit is generally maintained by generating a temperature-compensating voltage that corresponds to the operating temperature, and using the temperature-compensating voltage to operate the circuit. For example, in a memory circuit, when reading data, if the reading current is reduced due to the temperature changes, the reading margin will be reduced, and the data cannot be read correctly. Therefore, to prevent a drop in the reading current, the data is usually read by using the temperature-compensating voltage, or by ensuring that the reference current (which is compared with the reading current) has the same temperature dependency as the reading current. For example, JP2016173869A discloses a method to generate a reference current by adding the voltage compensating current and the temperature-compensating current to the base current, which does not depend on temperature and the power supply voltage.

As described above, the semiconductor device is equipped with a temperature-compensating circuit to generate the temperature-dependent voltage in response to the change of temperature. FIG. 1(A) shows one example of a conventional temperature-compensating circuit. The temperature-compensating circuit comprises an on-chip temperature sensor 10, a logic unit 20 and an analog unit 30. The logic unit 20 receives the detecting result of the temperature sensor 10, and calculates the voltage level of the temperature-compensating voltage. The analog unit 30 outputs the temperature-compensating voltage based on the calculation result of the logic unit 20.

The temperature sensor 10 comprises a reference circuit 12 and an ADC (analog-digital converter) 14. The reference circuit 12 generates the reference voltage $V_{REF}$ without dependency on temperature, and the sensing voltage $V_{SEN}$ in response to the operating temperature on chip. The ADC 14 receives the reference voltage $V_{REF}$ and the sensing voltage $V_{SEN}$, and converts the analog voltage of the sensing voltage $V_{SEN}$ to digital signal. For example, as shown in FIG. 1(B), the ADC 14 sets the minimum level according to the reference voltage $V_{REF}$. The logic unit 20 calculates how much temperature-compensating voltage will be generated from the analog unit 30 based on the trimming code that compensates for manufacturing tolerances and the digital output from the temperature sensor 10. The analog unit comprises a plurality of regulators for generating the temperature-compensating voltage based on the calculation result of the logic unit 20. For example, in order to read the data from the memory cell, one of the regulators can generate a reading voltage that can be applied to the gate of the transistor.

FIG. 1(B) shows the relationship between the sensing voltage $V_{SEN}$ with a positive slope Tc in response to the change of the temperature Ta (for example, is the operating temperature of the semiconductor device) and the output of the ADC 14. As shown in this figure, the ADC 14 quantizes the sensing voltage $V_{SEN}$ with a step width (digital processing) from the minimum level to the maximum level. Therefore, the temperature-compensating voltage output by the analog unit 30 will finally contain the quantization noise (step width), which may cause the temperature-compensating voltage not to be linear or not to be the requested temperature-compensating voltage. For example, when a temperature-compensating voltage $V_{Tp}$ is used in a transition temperature, the temperature-compensating voltage $V_{Tp}$ may not be able to compensate the change of temperature due to the quantization noise. Therefore, the optimal operating performance of the circuit may not be achieved. In addition, the on-chip temperature sensor 10 or the logic unit 20 has a large circuit scale, so a larger layout is required, and the control of the logic unit 20 is also very complicated.

BRIEF SUMMARY OF THE INVENTION

To solve the problems with the prior art, the present invention provides a voltage-generating circuit and a semiconductor device using the same with a simple configuration capable of saving space and generating a reliable voltage.

The voltage-generating circuit of the present invention comprises a reference voltage-generating unit, a temperature-dependent voltage-generating unit, a comparison unit, and a selection unit. The reference voltage-generating unit generates a reference voltage that is essentially independent of temperature. The temperature-dependent voltage-generating unit is configured to have a positive or negative dependency on temperature. The temperature-dependent voltage-generating unit is configured to generate at least one temperature-dependent voltage that is equal to the reference voltage at the target temperature. The comparison unit compares the reference voltage with the temperature-dependent voltage. The selection unit selects the reference voltage during a first condition and select the temperature-dependent voltage during a second condition based on the comparison result of the comparison unit, and outputs the selected one as a temperature-compensating reference voltage. The first condition and the second condition have different relationships between the target temperature and an operating temperature.

The semiconductor device according to the present invention comprises the voltage-generating circuit described above and a driving device. The driving device drives a circuit based on the temperature-compensating reference voltage generated by the voltage-generating circuit. In one embodiment, the driving device comprises a transistor connected to a memory cell. The driving device applies a first driving voltage based on the reference voltage to the gate of the transistor when the operating temperature is lower than the target temperature. The driving device applies a second driving voltage based on the temperature-dependent voltage to the gate of the transistor when the operating temperature is higher than the target temperature.

According to the present invention, a highly reliable voltage can be obtained by comparing the reference voltage with the temperature-dependent voltage; selecting the reference voltage or the temperature-dependent voltage based on the comparison result; and outputting the selected reference voltage or the temperature-dependent voltage. The voltage does not comprise the quantization noise generated by the AD converter. In addition, there is no need for an on-chip temperature sensor like the conventional one, or the logic for calculating the temperature-compensating voltage from the result of the temperature sensor. Therefore, it is possible to reduce the size of the circuit scale and save space.

BRIEF DESCRIPTION OF THE DRAWINGS

FIG. 4(A)-(C-2) is a waveform of the temperature-compensating reference voltage generated by the first and second embodiments of the present invention.

FIG. 7(A)-(E-2) is a waveform of the temperature-compensating reference voltage generated by the third and the fourth embodiment of the present invention.

DETAILED DESCRIPTION OF THE INVENTION

Next, the embodiments of the present invention will be described with reference to the drawings. The temperature-compensating reference voltage generated by the voltage-generating circuit according to the present invention can accurately meet the design specifications of the circuit of the semiconductor device. The temperature-compensating reference voltage may or may not have a dependency on temperature within a certain temperature range. The voltage-generating circuit compares at least one of the voltages essentially without dependency on temperature with at least one of the voltages with dependency on temperature, selects either a higher voltage, a lower voltage, or a voltage generated by another method, the voltage generated by another method essentially has dependency on temperature or essentially doesn't have dependency on temperature, and outputs the selected voltage as a temperature-compensating voltage. For example, when the temperature Ta is lower than the target temperature, the voltage-generating circuit outputs a reference voltage with an essentially constant slope; when the temperature Ta is higher than or equal to the target temperature, the voltage-generating circuit outputs a temperature-dependent voltage with a positive or negative slope.

The voltage-generating device can be used in various semiconductor devices, such as: resistive memory, flash memory, microprocessors, microcontrollers, logic circuits, application specific integrated circuits (ASIC), digital signal processors, circuitry for processing video or audio, and circuits for processing wireless signals, etc.

Figure 1A:
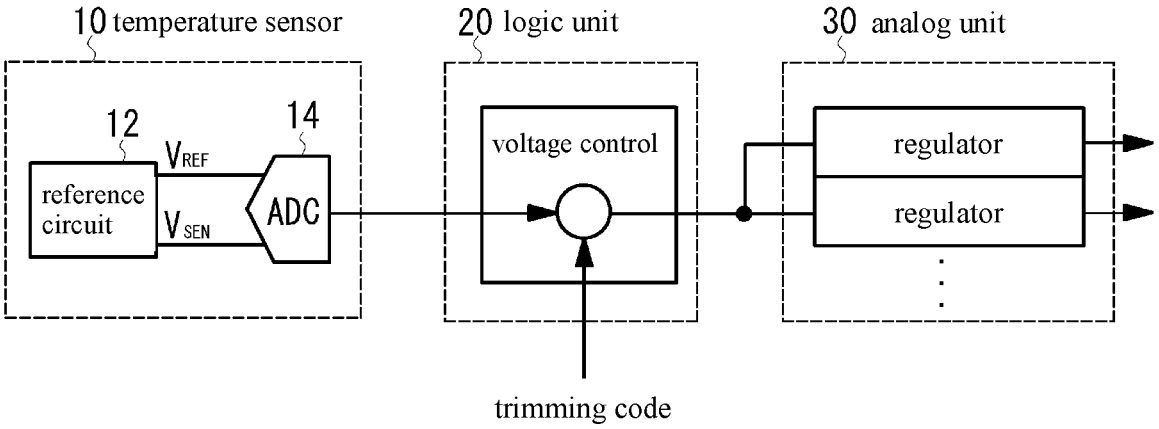
FIG. 1(A)-1(B) describes a method to generate the temperature-compensating reference voltage by using a conventional on-chip temperature sensor.
Figure 1:
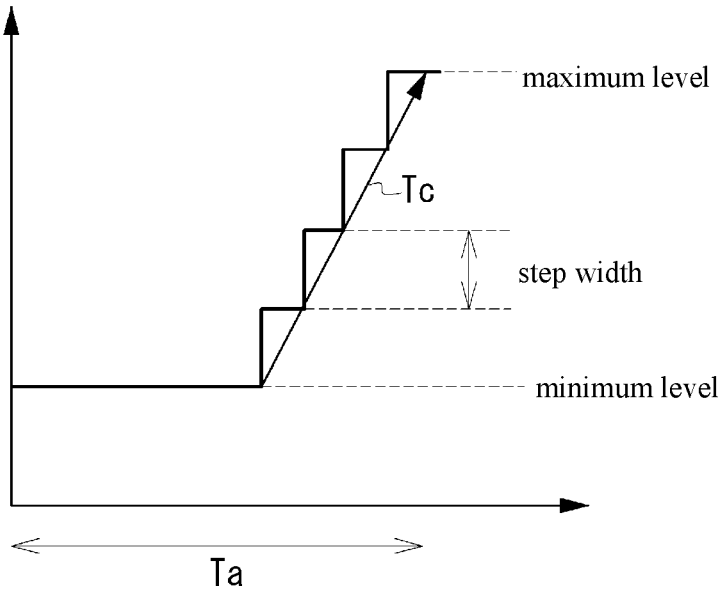
Figure 2:
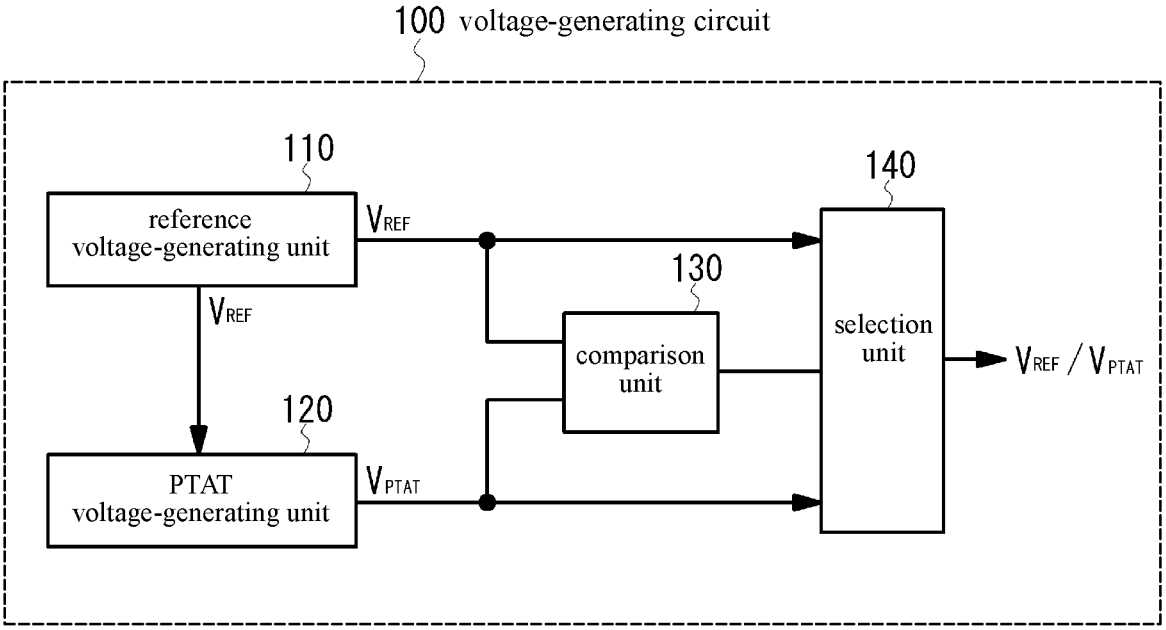
FIG. 2 is a block diagram showing the configuration of the voltage-generating circuit according to the first embodiment of the present invention.

FIG. 2 is a block diagram of the configuration of the voltage-generating circuit according to the first embodiment of the present invention. The voltage-generating circuit 100 comprises a reference voltage-generating unit 110, a PTAT (proportional-to-absolute-temperature) voltage-generating unit 120, a comparison unit 130 and a selection unit 140. The reference voltage-generating unit 110 generates a reference voltage $V_{REF}$ essentially without dependency on temperature. The PTAT voltage-generating unit 120 generates a temperature-dependent voltage $V_{PTAT}$ with dependency on temperature. The comparison unit 130 compares the reference voltage $V_{REF}$ with the temperature-dependent voltage $V_{PTAT}$. The selection unit 140 selects and outputs either the reference voltage $V_{REF}$ or the temperature-dependent voltage $V_{PTAT}$.

The reference voltage-generating unit 110 comprises a band gap reference circuit (hereinafter referred to as BGR circuit), which generates a voltage essentially without dependency on the power supply voltage or the operating temperature. The reference voltage-generating unit 110 uses the voltage generated by the BGR circuit to generate the reference voltage $V_{REF}$. In addition, although not shown here, the reference voltage-generating unit 110 may also comprise a trimming circuit to compensate for circuit manufacturing tolerances. The trimming circuit, for example, comprises a variable resistor with a resistance value changed according to a trim code read from the non-volatile memory. The trimming circuit adjusts the voltage level of the reference voltage $V_{REF}$ by the variable resistor.

The PTAT voltage-generating unit 120 generates the temperature-dependent voltage $V_{PTAT}$ with a positive slope, or generates the temperature-dependent voltage $V_{PTAT}$ with a negative slope. In one embodiment, the PTAT voltage-generating unit 120 can use the reference voltage $V_{REF}$ generated by the reference voltage-generating unit 110 to generate the temperature-dependent voltage $V_{PTAT}$, but the embodiment is not limited to this; the PTAT voltage-generating unit 120 can also generate the temperature-dependent voltage $V_{PTAT}$ by itself.

The PTAT voltage-generating unit 120 can be adjusted in advance to generate a voltage with a positive or negative slope required by the circuit when the operating temperature changes. For example, when the operating temperature exceeds a certain temperature Tp, if a voltage with a positive slope $\alpha$ is required, the PTAT voltage-generating unit 120 can be adjusted in advance to generate a temperature-dependent voltage $V_{PTAT}$ with a positive slope $\alpha$. Alternatively, when the operating temperature exceeds a certain temperature Tp, if a voltage with a negative slope $\beta$ is required, the PTAT voltage-generating unit 120 can be adjusted in advance to generate a temperature-dependent voltage $V_{PTAT}$ with a negative slope $\beta$. The configuration of the PTAT voltage-generating unit 120 is not particularly limited. For example, the PTAT voltage-generating unit 120 can comprise at least one resistors with positive temperature characteristics, or at least one bipolar transistors with negative temperature characteristics, or a resistor made of semiconductor materials.

The comparison unit 130 receives and compares the reference voltage $V_{REF}$ and the temperature-dependent voltage $V_{PTAT}$, and outputs the comparison result to the selection unit 140. For example, when the reference voltage $V_{REF}$ is higher than or equal to the temperature-dependent voltage $V_{PTAT}$, the comparison unit 130 outputs the signal at the H level; when the reference voltage $V_{REF}$ is lower than the temperature-dependent voltage $V_{PTAT}$, the comparison unit 130 outputs the signal at the L level.

The selection unit 140 selects and outputs either the larger or the smaller one of the reference voltage $V_{REF}$ and the temperature-dependent voltage $V_{PTAT}$ based on the comparison result of the comparison unit 130. For example, when the reference voltage $V_{REF}$ is higher than or equal to the temperature-dependent voltage $V_{PTAT}$, the selection unit 140 selects the reference voltage $V_{REF}$; when the reference voltage $V_{REF}$ is lower than the temperature-dependent voltage $V_{PTAT}$, the selection unit 140 selects the temperature-dependent voltage $V_{PTAT}$. In an alternative embodiment, the above relationship can be reversible, that is: when the reference voltage $V_{REF}$ is higher than or equal to the temperature-dependent voltage $V_{PTAT}$, the selection unit 140 selects the temperature-dependent voltage $V_{PTAT}$; when the reference voltage $V_{REF}$ is lower than the temperature-dependent voltage $V_{PTAT}$, the selection unit 140 selects the reference voltage $V_{REF}$.

FIG. 4(A)-(B) shows examples of the relationship between the reference voltage $V_{REF}$ and the temperature-dependent voltage $V_{PTAT}$. In FIG. 4(A), in response to the change of the temperature Ta, the reference voltage-generating unit 110 generates a reference voltage $V_{REF}$ essentially with no slope, and the PTAT voltage-generating unit 120 generates a temperature-dependent voltage $V_{PTAT}$ with a positive slope. The unit of the temperature Ta, for example, is Celsius [C], and the unit of the reference voltage $V_{REF}$ and the temperature-dependent voltage $V_{PTAT}$, for example, is volt [V]. The target temperature Tg is the corresponding temperature when the reference voltage $V_{REF}$ is equal to the temperature-dependent voltage $V_{PTAT}$, and the temperature-compensating is performed with the target temperature Tg as the boundary. The PTPT voltage-generating unit 120 can be adjusted in advance to generate a temperature-dependent voltage $V_{PTAT}$ that crosses the reference voltage $V_{REF}$ at the target temperature Tg and has the required positive slope.

In one embodiment illustrated in FIG. 4(A), the output of the selection unit 140 is shown in FIG. 4 (A-1), and the selection unit 140 selects the higher one of the reference voltage $V_{REF}$ and the temperature-dependent voltage $V_{PTAT}$ as the output. Therefore, the temperature-compensating reference voltage $V_{GREF}$ output by the voltage-generating circuit 100 is equal to the reference voltage $V_{REF}$ when the temperature Ta is lower than the target temperature Tg; and is equal to the temperature-dependent voltage $V_{PTAT}$ when the temperature Ta is higher than or equal to the target temperature Tg.

In one embodiment illustrated in FIG. 4(A), the output of the selection unit 140 is shown in FIG. 4(A-2), and the selection unit 140 selects the lower one of the reference voltage $V_{REF}$ and the temperature-dependent voltage $V_{PTAT}$ as the output. In this case, the temperature-compensating reference voltage $V_{GREF}$ output by the voltage-generating circuit 100 is equal to the temperature-dependent voltage $V_{PTAT}$ when the temperature Ta is lower than the target temperature Tg; and is equal to the reference voltage $V_{REF}$ when the temperature Ta is higher than or equal to the target temperature Tg.

On the other hand, in FIG. 4(B), in response to the change of the temperature Ta, the reference voltage-generating unit 110 generates a reference voltage $V_{REF}$ essentially with no slope, and the PTAT voltage-generating unit 120 generates a temperature-dependent voltage $V_{PTAT}$ with a negative slope. The PTPT voltage-generating unit 120 can be adjusted in advance to generate a temperature-dependent voltage $V_{PTAT}$ that crosses the reference voltage $V_{REF}$ at the target temperature Tg and has the required negative slope.

In one embodiment illustrated in FIG. 4(B), the output of the selection unit 140 is shown in FIG. 4(B-1), and the selection unit 140 selects the higher one of the reference voltage $V_{REF}$ and the temperature-dependent voltage $V_{PTAT}$ as the output. Therefore, the temperature-compensating reference voltage $V_{GREF}$ output by the voltage-generating circuit 100, is equal to the temperature-dependent voltage $V_{PTAT}$ when the temperature Ta is lower than the target temperature Tg; and is equal to the reference voltage $V_{REF}$ when the temperature Ta is higher than or equal to the target temperature Tg.

In one embodiment illustrated in FIG. 4(B), the output of the selection unit 140 is shown in FIG. 4(B-2), and the selection unit 140 selects the lower one of the reference voltage $V_{REF}$ and the temperature-dependent voltage $V_{PTAT}$ as the output. In this case, the temperature-compensating reference voltage $V_{GREF}$ output by the voltage-generating circuit 100, is equal to the reference voltage $V_{REF}$ when the temperature Ta is lower than the target temperature Tg; and is equal to the temperature-dependent voltage $V_{PTAT}$ when the temperature Ta is higher than or equal to the target temperature Tg.

The temperature-compensating reference voltage $V_{GREF}$ output by the voltage-generating circuit 100 can be directly provided to the corresponding circuit; or it can also be converted to the expected voltage level by the converting circuit such as the operational amplifier or the regulator, and then provided to the corresponding circuit.

Figure 3:
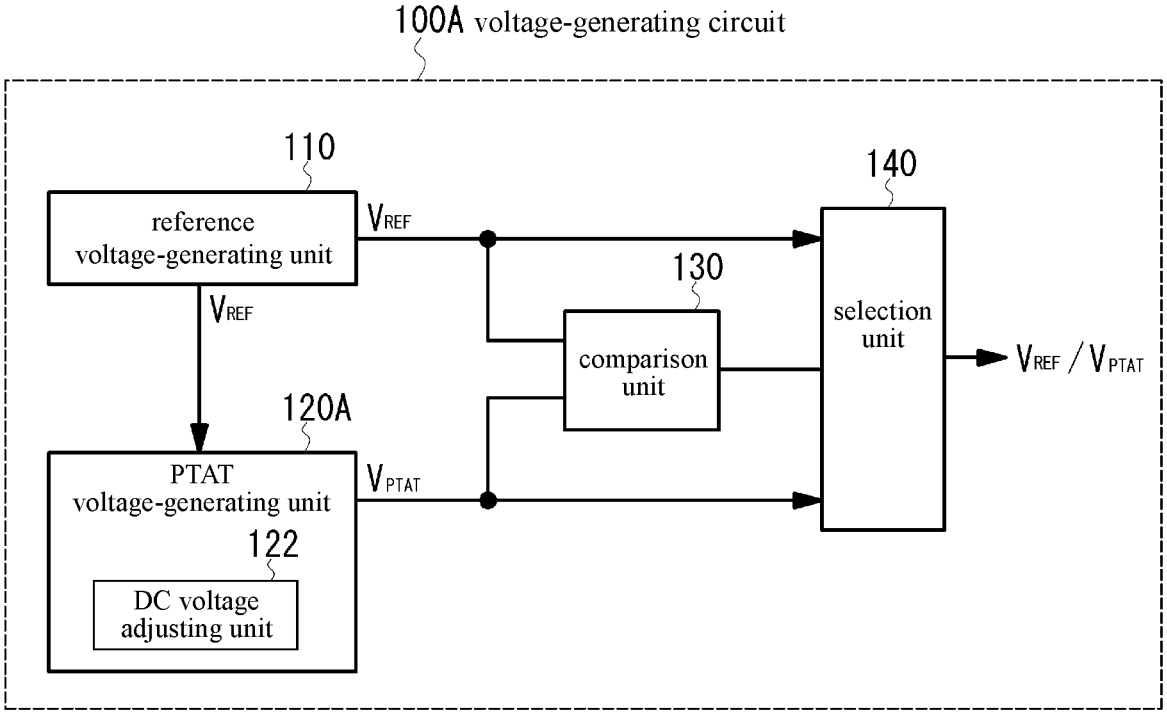
FIG. 3 is a block diagram showing the configuration of the voltage-generating circuit according to the second embodiment of the present invention.

Next, the second embodiment of the present invention will be described. FIG. 3 shows the configuration of the voltage-generating circuit 100A according to the second embodiment, and the same configuration as in FIG. 2 will be given the same symbol. In the second embodiment, the PTAT voltage-generating unit 120A comprises a DC (direct current) voltage adjusting unit 122 configured to offset the DC voltage of the temperature-dependent voltage $V_{PTAT}$ in the positive or negative direction. As described above, the temperature-dependent voltage $V_{PTAT}$ can be set to cross the reference voltage $V_{REF}$ at the target temperature Tg. However, due to some reasons like circuit manufacturing tolerances, sometimes the target temperature Tg needs to be adjusted in the positive or negative direction.

For example, as shown in FIG. 4(C), the initial temperature-dependent voltage $V_{PTAT_int}$ generated by the PTAT voltage-generating unit 120A crosses the reference voltage VREF at the target temperature Tg. However, the target temperature Tg is affected by such as circuit manufacturing tolerances, so in this embodiment, the target temperature Tg is offset to Tg-P or Tg+P by the DC voltage adjusting unit 122. As shown in FIG. 4(C-1), the DC voltage adjusting unit 122 can add the DC offset voltage $V_{OFFSET}$ to the initial temperature-dependent voltage $V_{PTAT_int}$, to generate the temperature-dependent voltage $V_{PTAT}$, in order to offset the target temperature Tg down to Tg-P. Alternatively, as shown in FIG. 4(C-2), the DC voltage adjusting unit 122 can subtract the DC offset voltage $V_{OFFSET}$ from the initial temperature-dependent voltage $V_{PTAT_int}$, to generate the temperature-dependent voltage $V_{PTAT}$, in order to offset the target temperature Tg up to Tg+P.

Figure 5:
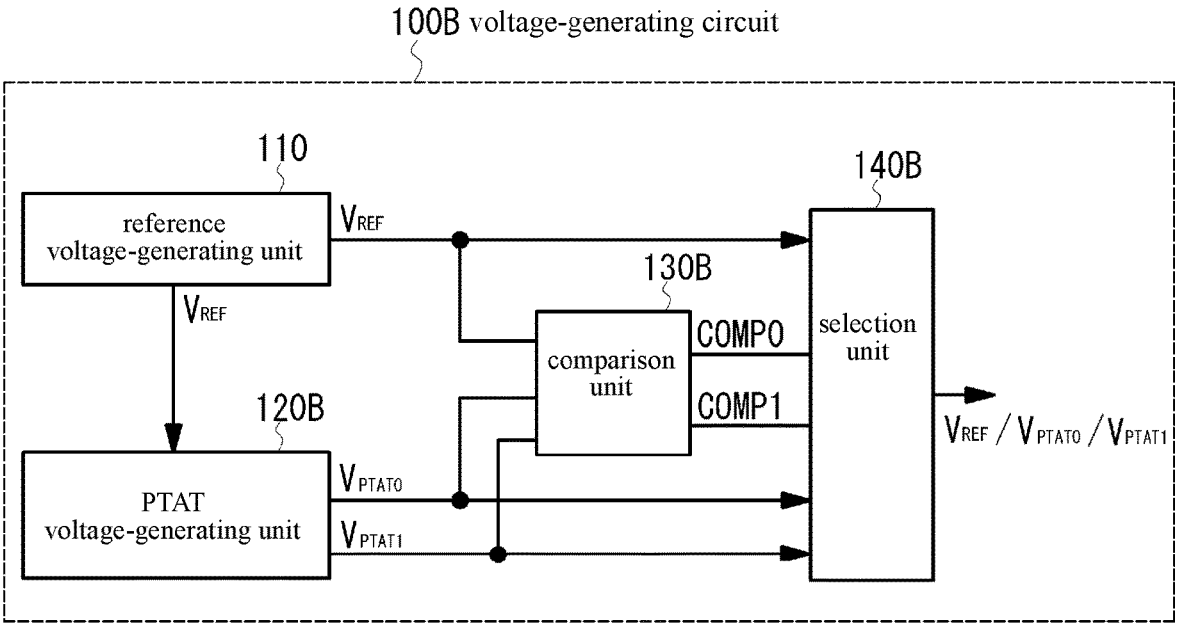
FIG. 5 is a block diagram showing the configuration of the voltage-generating circuit according to the third embodiment of the present invention.

Next, the third embodiment of the present invention will be described. FIG. 5 is a block diagram showing the configuration of the voltage-generating circuit 100B according to the third embodiment, and the same configuration as in FIG. 2 will be given the same symbol. In the third embodiment, the PTAT voltage-generating unit 120B generates two temperature-dependent voltages $V_{PTAT0}$ and $V_{PTAT1}$ with different slopes. The two temperature-dependent voltages $V_{PTAT0}$ and $V_{PTAT1}$ cross the reference voltage $V_{REF}$ at different target temperatures Tg0 and Tg1, respectively, and both of them have required slopes. The comparison unit 130B compares the reference voltage $V_{REF}$ with the temperature-dependent voltage $V_{PTAT0}$, and compares the reference voltage $V_{REF}$ with the temperature-dependent voltage $V_{PTAT1}$, and outputs the respective comparison results COMP0 and COMP1 to the selection unit 140B.

The selection unit 140B selects one of the reference voltage $V_{REF}$, the temperature-dependent voltages $V_{PTAT0}$ and $V_{PTAT1}$ as the temperature-compensating reference voltage $V_{GREF}$, based on a logical combination of the comparison results COMP0 and COMP1. FIGS. 7(A)-(D) show a plurality of patterns. In the example of FIG. 7(A), the temperature-dependent voltage $V_{PTAT0}$ has a negative slope, and crosses the reference voltage $V_{REF}$ at the target temperature Tg0; the temperature-dependent voltage $V_{PTAT1}$ has a positive slope, and crosses the reference voltage $V_{REF}$ at the target temperature Tg1. According to the example of FIG. 7(A), in one embodiment, the output of the selection unit 140B can be as shown in the example of FIG. 7(A-1). When the temperature Ta is lower than the target temperature Tg0, the selection unit 140B selects and outputs the temperature-dependent voltage $V_{PTAT0}$ which has the higher voltage as the temperature-compensating reference voltage $V_{GREF}$. When the temperature Ta is between the target temperatures Tg0 and Tg1, the selection unit 140B selects and outputs the reference voltage $V_{REF}$ which has the higher voltage as the temperature-compensating reference voltage $V_{GREF}$. When the temperature Ta is higher than the target temperature Tg1, the selection unit 140B selects and outputs the temperature-dependent voltage $V_{PTAT1}$ which has the higher voltage as the temperature-compensating reference voltage $V_{GREF}$. In addition, according to the example of FIG. 7(A), in one embodiment, the output of the selection unit 140B can be as shown in the example of FIG. 7(A-2). When the temperature Ta is lower than the target temperature Tg0, the selection unit 140B selects and outputs the reference voltage $V_{REF}$ which has the lower voltage as the temperature-compensating reference voltage $V_{GREF}$. When the temperature Ta is between the target temperatures Tg0 and Tg1, the selection unit 140B selects and outputs the temperature-dependent voltages $V_{PTAT0}$ and $V_{PTAT1}$ which are lower than the reference voltage $V_{REF}$ as the temperature-compensating reference voltage $V_{GREF}$. In more detail, the temperature-dependent voltages $V_{PTAT0}$ and $V_{PTAT1}$ intersect at an intermediate temperature between target temperatures Tg0 and Tg1. When the temperature Ta is between the target temperature Tg0 and the intermediate temperature where the temperature-dependent voltages $V_{PTAT0}$ and $V_{PTAT1}$ intersect at, the selection unit 140B selects and outputs the temperature-dependent voltages $V_{PTAT0}$; when the temperature Ta is between the intermediate temperature and target temperature Tg1, the selection unit 140B selects and outputs the temperature-dependent voltages $V_{PTAT1}$. When the temperature Ta is higher than the target temperature Tg1, the selection unit 140B selects and outputs the reference voltage $V_{REF}$ which is lower than the temperature-dependent voltage $V_{PTAT1}$ as the temperature-compensating reference voltage $V_{GREF}$.

In the example of FIG. 7(B), the temperature-dependent voltage $V_{PTAT0}$ has a positive slope, and crosses the reference voltage $V_{REF}$ at the target temperature Tg0; the temperature-dependent voltage $V_{PTAT1}$ has a negative slope, and crosses the reference voltage $V_{REF}$ at the target temperature Tg1. According to the example of FIG. 7(B), in one embodiment, the output of the selection unit 140B can be as shown in the example of FIG. 7(B-1). When the temperature Ta is lower than the target temperature Tg0, the selection unit 140B selects and outputs the temperature-dependent voltage $V_{PTAT0}$ which has the lower voltage as the temperature-compensating reference voltage $V_{GREF}$. When the temperature Ta is between the target temperatures Tg0 and Tg1, the selection unit 140B selects and outputs the reference voltage $V_{REF}$ which has the lower voltage as the temperature-compensating reference voltage $V_{GREF}$. When the temperature Ta is higher than the target temperature Tg1, the selection unit 140B selects and outputs the temperature-dependent voltage $V_{PTAT1}$ which has the lower voltage as the temperature-compensating reference voltage $V_{GREF}$. In addition, according to the example of FIG. 7(B), in one embodiment, the output of the selection unit 140B can be as shown in the example of FIG. 7(B-2). When the temperature Ta is lower than the target temperature Tg0, the selection unit 140B selects and outputs the reference voltage $V_{REF}$ which has the higher voltage as the temperature-compensating reference voltage $V_{GREF}$. When the temperature Ta is between the target temperatures Tg0 and Tg1, the selection unit 140B selects and outputs the temperature-dependent voltages $V_{PTAT0}$ and $V_{PTAT1}$ which are higher than the reference voltage $V_{REF}$ as the temperature-compensating reference voltage $V_{GREF}$. In more detail, the temperature-dependent voltages $V_{PTAT0}$ and $V_{PTAT1}$ intersect at an intermediate temperature between target temperatures Tg0 and Tg1. When the temperature Ta is between the target temperature Tg0 and the intermediate temperature where the temperature-dependent voltages $V_{PTAT0}$ and $V_{PTAT1}$ intersect at, the selection unit 140B selects and outputs the temperature-dependent voltages $V_{PTAT0}$; when the temperature Ta is between the intermediate temperature and target temperature Tg1, the selection unit 140B selects and outputs the temperature-dependent voltages $V_{PTAT1}$. When the temperature Ta is higher than the target temperature Tg1, the selection unit 140B selects and outputs the reference voltage $V_{REF}$ which is higher than the temperature-compensating reference voltage $V_{GREF}$.

In the example of FIG. 7(C), the temperature-dependent voltage $V_{PTAT0}$ has a positive slope, and crosses the reference voltage $V_{REF}$ at the target temperature Tg0; the temperature-dependent voltage $V_{PTAT1}$ has a positive slope, and crosses the reference voltage $V_{REF}$ at the target temperature Tg1. The slope of the temperature-dependent voltage $V_{PTAT0}$ and the slope of the temperature-dependent voltage $V_{PTAT1}$ can be the same or be different. According to this, the output of the selection unit 140B can be as shown in the example of FIG. 7(C-1). When the temperature Ta is lower than the target temperature Tg0, the selection unit 140B selects and outputs the temperature-dependent voltages $V_{PTAT0}$ which has the lower voltage as the temperature-compensating reference voltage $V_{GREF}$. When the temperature Ta is between the target temperatures Tg0 and Tg1, the selection unit 140B selects and outputs the reference voltage $V_{REF}$ whose voltage is between the temperature-dependent voltages $V_{PTAT0}$ and the temperature-dependent voltages $V_{PTAT1}$ as the temperature-compensating reference voltage $V_{GREF}$. When the temperature Ta is higher than the target temperature Tg1, the selection unit 140B selects and outputs the temperature-dependent voltages $V_{PTAT1}$ which has the higher voltage as the temperature-compensating reference voltage $V_{GREF}$.

In the example of FIG. 7(D), the temperature-dependent voltage $V_{PTAT0}$ has a negative slope, and crosses the reference voltage $V_{REF}$ at the target temperature Tg0; the temperature-dependent voltage $V_{PTAT1}$ has a negative slope, and crosses the reference voltage $V_{REF}$ at the target temperature Tg1. The slope of the temperature-dependent voltage $V_{PTAT0}$ and the slope of the temperature-dependent voltage $V_{PTAT1}$ can be the same or be different. According to this, the output of the selection unit 140B can be as shown in the example of FIG. 7(D-1). When the temperature Ta is lower than the target temperature Tg0, the selection unit 140B selects and outputs the temperature-dependent voltages $V_{PTAT0}$ which has the higher voltage as the temperature-compensating reference voltage $V_{GREF}$. When the temperature Ta is between the target temperatures Tg0 and Tg1, the selection unit 140B selects and outputs the reference voltage $V_{REF}$ whose voltage is between the temperature-dependent voltages $V_{PTAT0}$ and the temperature-dependent voltages $V_{PTAT1}$ as the temperature-compensating reference voltage $V_{GREF}$. When the temperature Ta is higher than the target temperature Tg1, the selection unit 140B selects and outputs the temperature-dependent voltages $V_{PTAT1}$ which has the lower voltage as the temperature-compensating reference voltage $V_{GREF}$.

In this way, according to this embodiment, two boundaries (target temperatures Tg0 and Tg1) can be used to generate the temperature-compensating reference voltage $V_{GREF}$ with different temperature characteristics, and the variability of the temperature-compensating voltage can be increased. In addition, the DC voltage adjusting unit 122 described in the second embodiment can be applied to the third embodiment.

Figure 6:
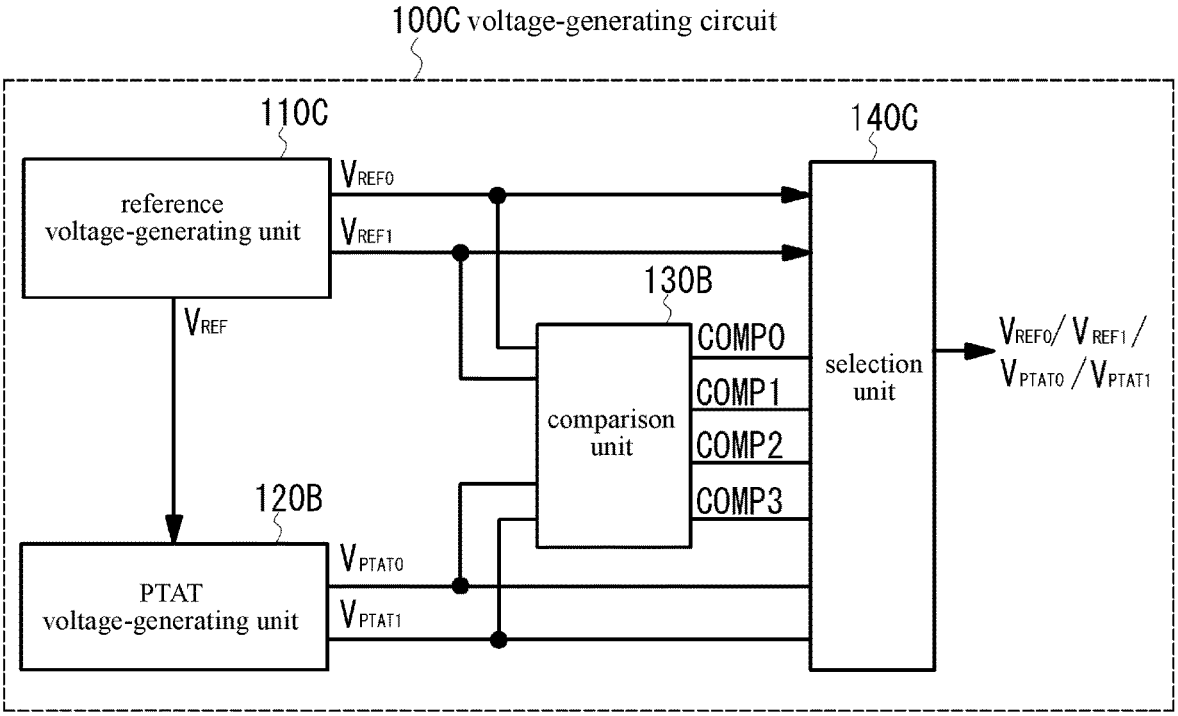
FIG. 6 is a block diagram showing the configuration of the voltage-generating circuit according to the fourth embodiment of the present invention.

Next, the fourth embodiment of the present invention will be described. FIG. 6 is a block diagram showing the configuration of the voltage-generating circuit 100C according to the fourth embodiment, and the same configuration as in FIG. 5 will be given the same symbol. In the fourth embodiment, the reference voltage-generating unit 110C generates two different reference voltages $V_{REF0}$ and $V_{REF1}$. In this case, the two temperature-dependent voltages $V_{PTAT0}$ and $V_{PTAT1}$ will respectively cross the two reference voltages $V_{REF0}$ and $V_{REF1}$ at two target temperatures. The comparison unit 130B compares four combinations of two reference voltages $V_{REF0}$ and $V_{REF1}$ and two temperature-dependent voltages $V_{PTAT0}$ and $V_{PTAT1}$, and outputs a plurality of comparison results COMP0, COMP1, COMP2 and COMP3 to the selection unit 140C. The selection unit 140C selects one of the reference voltages $V_{REF0}$, $V_{REF1}$, and the temperature-dependent voltages $V_{PTAT0}$ and $V_{PTAT1}$ based on a logical combination of the comparison results COMP0, COMP1, COMP2 and COMP3, and outputs one of the four voltages as the temperature-compensating reference voltage $V_{GREF}$.

In the example of FIG. 7(E), the temperature-dependent voltage $V_{PTAT0}$ has a positive slope, and crosses the reference voltage $V_{REF}$ at the target temperature Tg0; the temperature-dependent voltage $V_{PTAT1}$ has a negative slope (in this embodiment, setting the absolute value of the negative slope so that it is equal to the positive slope of the temperature-dependent voltage $V_{PTAT0}$), and crosses the reference voltage $V_{REF}$ at the target temperature Tg1. According to the example of FIG. 7(E), in one embodiment, the output of the selection unit 140C can be as shown in the example of FIG. 7(E-1). When the temperature Ta is lower than the target temperature Tg0, the selection unit 140C selects and outputs the reference voltage $V_{REF0}$ (i.e. the lower one of these reference voltages) as the temperature-compensating reference voltage $V_{GREF}$. When the temperature Ta is between the target temperatures Tg0 and Tg1, the selection unit 140C selects and outputs the temperature-dependent voltages $V_{PTAT0}$ as the temperature-compensating reference voltage $V_{GREF}$. When the temperature Ta is higher than the target temperature Tg1, the selection unit 140C selects and outputs the reference voltage $V_{REF1}$ (i.e. the higher one of these reference voltages) as the temperature-compensating reference voltage $V_{GREF}$. According to the example of FIG. 7(E), in one embodiment, the output of the selection unit 140C can be as shown in the example of FIG. 7(E-2). When the temperature Ta is lower than the target temperature Tg0, the selection unit 140C selects and outputs the reference voltage $V_{REF1}$ (i.e. the higher one of these reference voltages) as the temperature-compensating reference voltage $V_{GREF}$. When the temperature Ta is between the target temperatures Tg0 and Tg1, the selection unit 140C selects and outputs the temperature-dependent voltages $V_{PTAT1}$ as the temperature-compensating reference voltage $V_{GREF}$. When the temperature Ta is higher than the target temperature Tg1, the selection unit 140C selects and outputs the reference voltage $V_{REF0}$ (i.e. the lower one of these reference voltages) as the temperature-compensating reference voltage $V_{GREF}$.

In this way, according to the embodiment, using the combination of two reference voltages $V_{REF0}$ and $V_{REF1}$ essentially without dependency on the temperature, and two temperature-dependent voltage $V_{PTAT0}$ and $V_{PTAT1}$ with dependency on the temperature, can generate a more complicated temperature-compensating reference voltage $V_{GREF}$. In addition, if such this temperature-compensating reference voltage $V_{GREF}$ is used and converted to the expected voltage level by the converting circuit such as the regulator or the operational amplifier, the temperature-compensating of the converted voltage can also be performed.

Figure 8A:
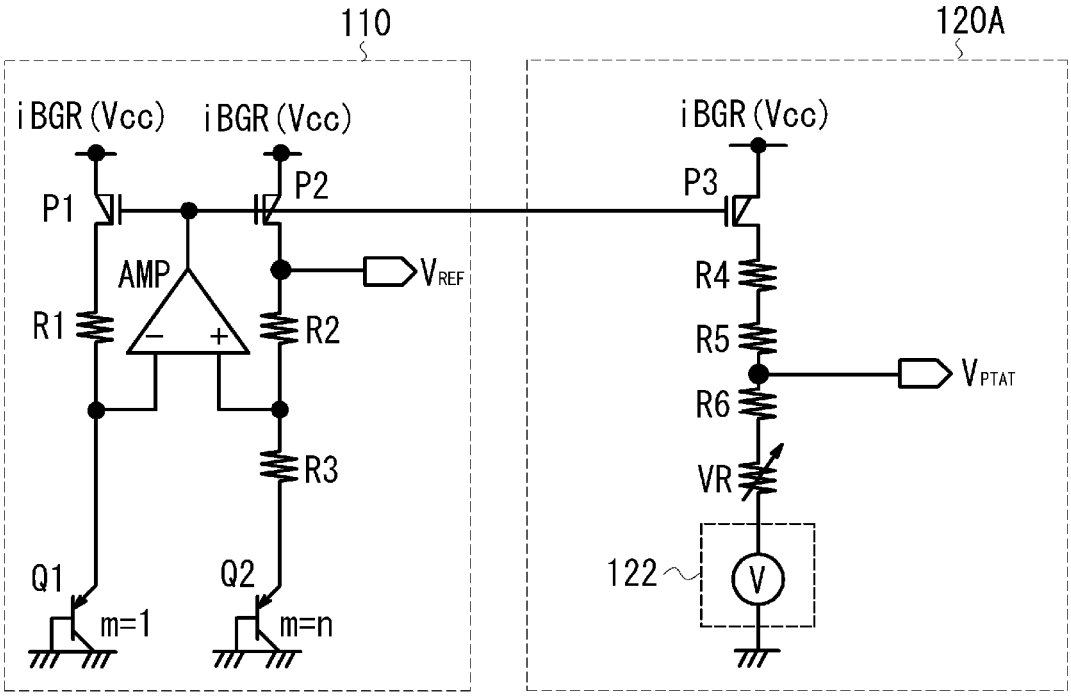
FIG. 8(A)-8(C) is an example of the detailed configuration of the voltage-generating circuit according to the second embodiment of the present invention.
Figure 8B:
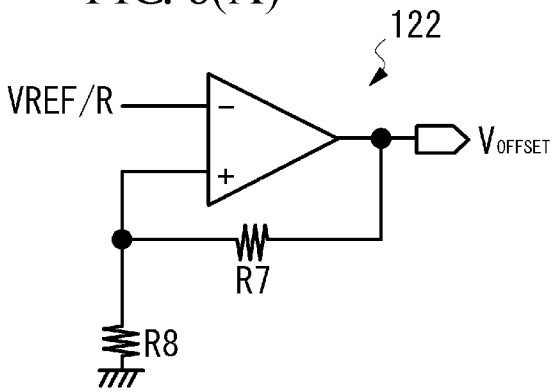
Figure 8C:
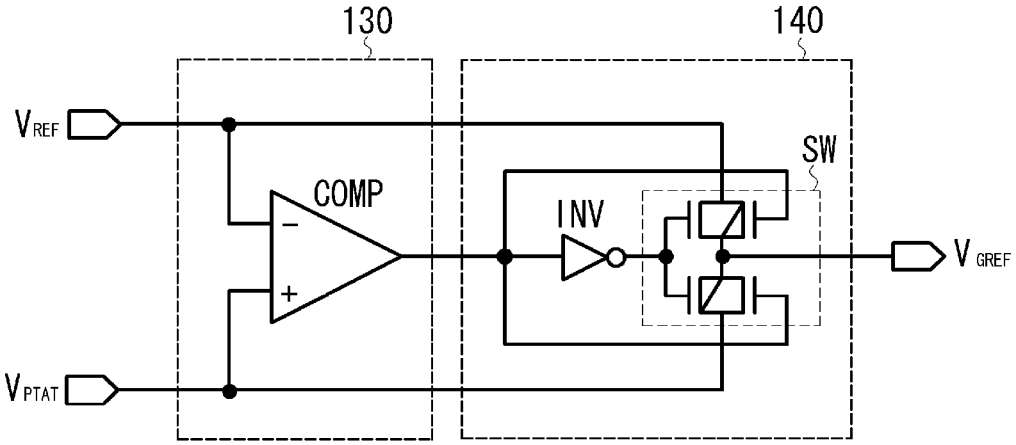

FIG. 8(A)-(C) is a schematic diagram of the voltage-generating circuit 100A according to the second embodiment of the present invention. The reference voltage-generating unit 110 comprises a BGR circuit which generates a voltage essentially without dependency on power supply voltage Vcc or the temperature. For example, as shown in the figure, the BGR circuit comprises a first path and a second path located between the power supply voltage Vcc and ground GND. The first path comprises a PMOS transistor P1, a resistor R1, and a bipolar transistor Q1 connected in series. The second path comprises a PMOS transistor P2, a resistor R2, a resistor R3, and a bipolar transistor Q2 (the emitter area of the bipolar transistor Q2 is m, which is n times the emitter area of the bipolar transistor Q1). In addition, the differential amplifier circuit AMP has an inverting input terminal (−) connected to the connecting node of the resistor R1 and the bipolar transistor Q1, a non-inverting input terminal (+) connected to the connecting node of the resistor R2 and the resistor R3, and an output terminal commonly connected to the gates of the PMOS transistor P1 and the PMOS transistor P2. By selecting resistors R1, R2, R3, the bipolar transistors Q1 and Q2 properly, it is possible to output the reference voltage $V_{REF}$ essentially without dependency on the temperature from the connecting node between the PMOS transistor P2 and the resistor R2.

The PTAT voltage-generating unit 120A comprises a PMOS transistor P3, resistors R4, R5, R6, a variable resistor VR and a DC voltage adjusting unit 122 connected in series between the power supply voltage Vcc and the ground GND. The gate of the PMOS transistor P3 is connected to the PMOS transistors P1 and P2 of the BGR circuit. The current iBGR flowing in the BGR circuit is also provided to the PTAT voltage-generating unit 120A as the current path through the PMOS transistor P3. The variable resistance VR adjusts the tolerances of the circuit, for example, the tap of the resistor division is switched according to the predetermined trimming code. By selecting resistors R4, R5, and R6 properly, it is possible to output the temperature-dependent voltage $V_{PTAT}$ from the connecting node between the resistor R5 and the resistor R6.

FIG. 8(B) shows the configuration of the DC voltage adjusting unit 122. The DC voltage adjusting unit 122 comprises a differential amplifier circuit. The differential amplifier circuit has an inverting input terminal (−) for receiving the divided reference voltage $V_{REF}$ divided by the resistor R, a non-inverting input terminal (+) for receiving the voltage of the voltage dividing node between the resistors R7 and R8, and an output connected to the resistor R7. By adjusting the resistor R, the DC voltage adjusting unit 122 outputs the DC offset voltage $V_{OFFSET}$, in order to offset the initial temperature-dependent voltage $V_{PTAT_int}$.

FIG. 8(C) shows the configuration of the comparison unit 130 and the selection unit 140. The comparison unit 10 comprises a comparator COMP, which receives the reference voltage $V_{REF}$ and the temperature-dependent voltage $V_{PTAT}$, compares the reference voltage $V_{REF}$ with the temperature-dependent voltage $V_{PTAT}$, and outputs the signal of H or L level to indicate the comparison result of the reference voltage $V_{REF}$ and the temperature-dependent voltage $V_{PTAT}$. The selection unit 140 comprises an inverter INV, which receives the output of the comparison unit 130; and a CMOS switch SW, which comprises a plurality of CMOS transistors. In this embodiment, one of the CMOS transistors of the CMOS switch SW receives the reference voltage $V_{REF}$, and the other CMOS transistor receives the temperature-dependent voltage $V_{PTAT}$, and the CMOS switch SW selects either the reference voltage $V_{REF}$ or the temperature-dependent voltage $V_{PTAT}$ based on the inverse value of the comparison result (i.e. the output of the inverter INV) of the comparator COMP, and outputs the selected one as the temperature-compensating reference voltage $V_{GREF}$. In one embodiment, the selection unit 140 selects the higher one of the temperature-dependent voltage $V_{PTAT}$ and the reference voltage $V_{REF}$ as the output based on the comparison result of the comparator COMP. For example, when the temperature-dependent voltage $V_{PTAT}$ is higher than the reference voltage $V_{REF}$, the output of the comparator COMP is at the H level, in the CMOS switch SW, the CMOS transistor connected to the temperature-dependent voltage $V_{PTAT}$ is turned on, the CMOS transistor connected to the reference voltage $V_{REF}$ is turned off, and outputs the temperature-dependent voltage $V_{PTAT}$ as the temperature-compensating reference voltage $V_{GREF}$.

Figure 9:
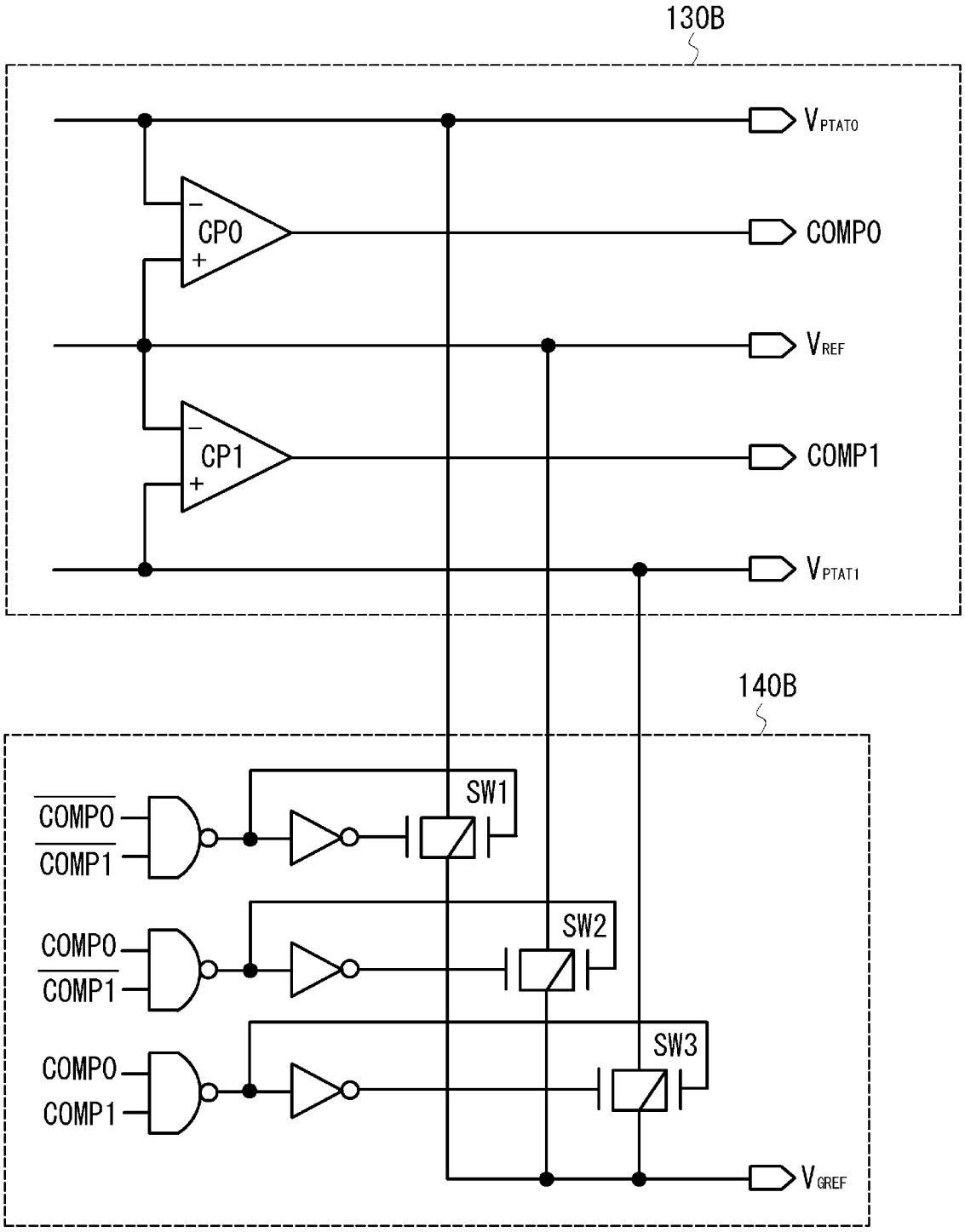
FIG. 9 is an example of the detailed configuration of the voltage-generating circuit according to the third embodiment of the present invention.

FIG. 9 is an example of the configuration of the voltage-generating circuit 100B according to the third embodiment of the present invention. In the third embodiment, the reference voltage-generating unit 110 generates the reference voltage $V_{REF}$, the PTAT voltage-generating unit 120B generates two temperature-dependent voltages $V_{PTAT0}$ and $V_{PTAT1}$, and the comparison unit 130B receives the reference voltage $V_{REF}$ and these temperature-dependent voltages $V_{PTAT0}$ and $V_{PTAT1}$. The comparison unit 130B comprises a comparator CP0 and a comparator CP1. The comparator CP0 compares the reference voltage $V_{REF}$ with the temperature-dependent voltage $V_{PTAT0}$, and outputs the comparison result COMP0. The comparator CP1 compares the reference voltage $V_{REF}$ with the temperature-dependent voltage $V_{PTAT1}$, and outputs the comparison result COMP1.

The selection unit 140B comprises three NAND gates, a plurality of inverters, and CMOS switches SW1, SW2, and SW3. The NAND gates are configured to perform the logical operation of a plurality of combinations of the comparison results COMP0 and COMP1 of the comparator CP0 and CP1. The inputs of the inverters are connected to the output of the NAND gates respectively. The CMOS switches SW1, SW2, and SW3 are connected to these inverters respectively. The input terminal of the CMOS switch SW1 receives the temperature-dependent voltage $V_{PTAT0}$; the input terminal of the CMOS switch SW2 receives the reference voltage $V_{REF}$; and the input terminal of the CMOS switch SW3 receives the temperature-dependent voltage $V_{PTAT1}$. One of the CMOS switches SW1, SW2, and SW3 is turned on according to the logical operating results of the COMP0 and COMP1, so that one of the temperature-dependent voltages $V_{PTAT0}$, $V_{PTAT1}$ and the reference voltage $V_{REF}$ can be selected and output as the temperature-compensating reference voltage $V_{GREF}$.

Figure 10:
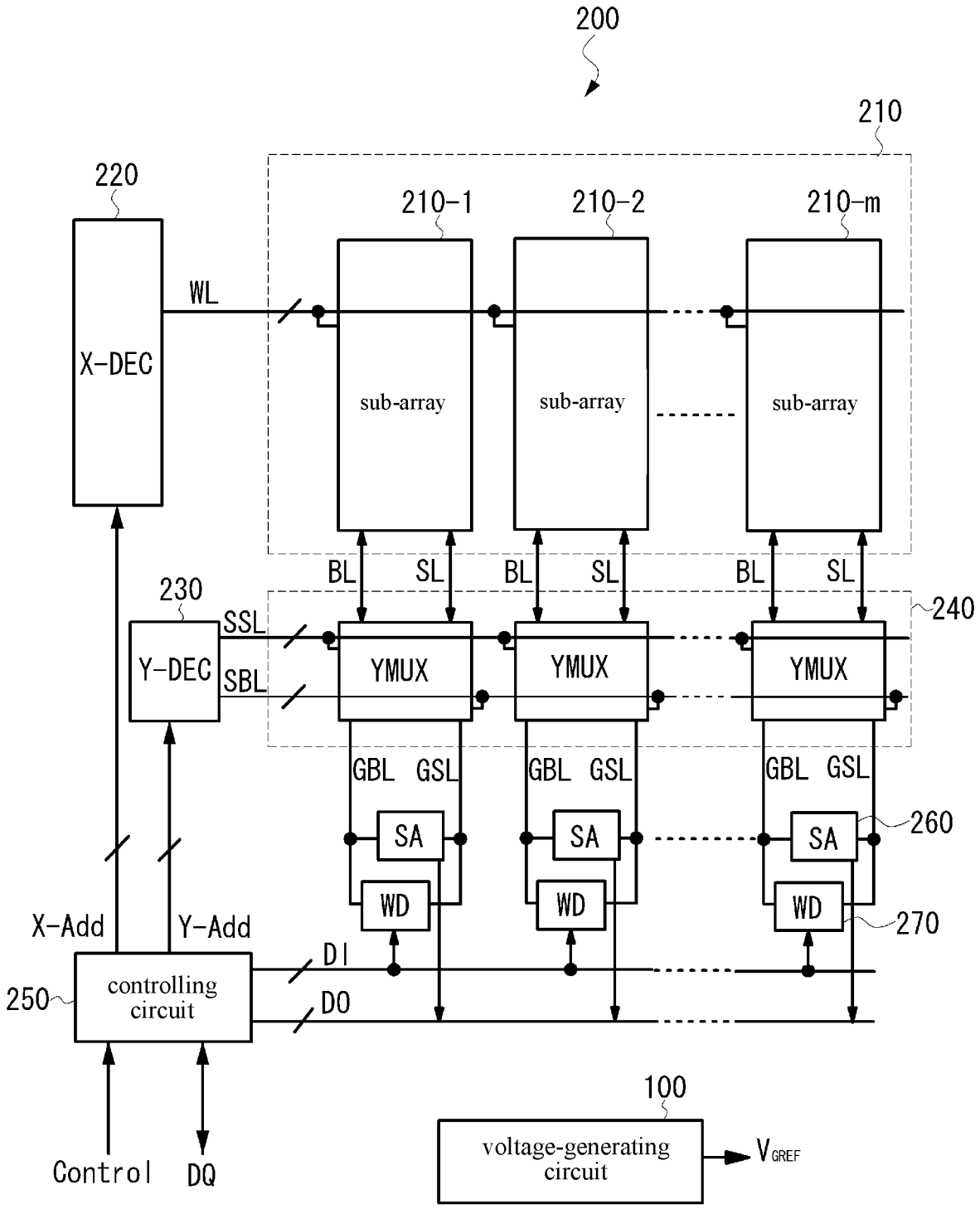
FIG. 10 shows the configuration of the resistive random access memory applying the voltage-generating circuit according to the embodiment of the present invention.

Next, FIG. 10 shows the configuration of the variable resistance random access memory as one example of the semiconductor device which the voltage-generating circuit of the embodiment of the present invention is applied to. The variable resistance memory 200 comprises a memory array 210, a row decoder and driving circuit (X-DEC) 220, a column decoder and driving circuit (Y-DEC) 230, a column selecting circuit (YMUX) 240, a controlling circuit 250, a sensing amplifier 260, a write driving/read bias circuit 270, and the above-mentioned voltage-generating circuit 100. The memory array 210 includes a plurality of memory cells is arranged in rows and columns, and each memory cell comprises a variable resistance element and an access transistor. The row decoder and driving circuit (X-DEC) 220 selects and drives the word line WL based on the row address X-Add. The column decoder and driving circuit (Y-DEC) 230 generates the selecting signal SSL/SBL based on the column address Y-Add, the selecting signals SBL and SSL are used for selecting the global bit line GBL and the global source line GSL, respectively. The column selecting circuit (YMUX) 240 selects the connection between the global bit line GBL and the bit line BL based on the selecting signal SBL, and selects the connection between the global source line GSL and the source line SL based on the selecting signal SSL. The controlling circuit 250 controls every units based on the command, the address, and the data received externally. The sensing amplifier 260 senses the data read from the memory cell through the selected global bit line GBL and the bit line BL. The write driving/read bias circuit 270 applies the bias voltage during a read operation, and applies the corresponding voltages for setting and resetting during a write operation through the selected global bit line GBL and the bit line BL. The voltage-generating circuit 100 generates the temperature-compensating reference voltage $V_{GREF}$ as described in the above embodiments.

The memory array 210 comprises m sub-arrays 210-1, 210-2, . . . , **210-*m*, the m sub-arrays connect to the corresponding m column selecting circuits (YMUX) 240. The m column selecting circuits (YMUX) 240 are connected to the sensing amplifier 260 and the write driving/read bias circuit 270. During a read operation, the reading data sensed by the sensing amplifier 260 is output to the controlling circuit 250 through the internal data bus DO; during a write operation, the writing data output externally is received from the controlling circuit 250 through the internal data bus DI to the write driving/read bias circuit 270**.

During accessing the memory cell, the row decoder and driving circuit (X-DEC) 220 selects the word line WL, so that the access transistor is turned on, and the selected memory cell is electrically connected to the selected bit line BL and the source line SL through the column selecting circuit (YMUX) 240. During a write operation, the voltage corresponding to the setting and resetting generated by the write driving/read bias circuit 270 is applied to the selected memory cell through the selected bit line BL and the selected source line SL. During a read operation, the reading voltage generated by the write driving/read bias circuit 270 is applied to the selected memory cell through the selected bit line BL and the selected source line SL, and then the voltage or the current on the variable resistance element after being set or reset can be sensed by the sensing amplifier 260 through the selected bit line BL and the selected source line SL. Generally, writing the variable resistance element into a low resistance state is "set"; writing the variable resistance element into a high resistance state is "reset".

The temperature-compensating reference voltage $V_{GREF}$ generated by the voltage-generating circuit 100 can be used in the write driving/read bias circuit 270 or the row decoder and driving circuit (X-DEC) 220, to generate the word line voltage for driving the access transistor, the setting voltage or the resetting for writing the selected memory cell, and the bias voltage for reading the selected memory cell.

Here, for example, when the operating temperature is higher than the room temperature (25° C.), it may cause the word line voltage for driving the access transistor to become insufficient, and the drain current flowing through the access transistor is reduced. Therefore, we hope that the pattern of the word line voltage generated by the row decoder and driving circuit (X-DEC) 220 will: be constant when the temperature Ta is lower than room temperature, while increase with a positive slope when the temperature Ta is higher than room temperature. Therefore, as shown in FIG. 4(A-1), the voltage-generating circuit 100 generates a temperature-compensating reference voltage $V_{GREF}$ whose target temperature Tg is the room temperature, and the temperature-compensating reference voltage $V_{GREF}$ will be provided to the X-DEC 220. The X-DEC 220 can use the temperature-compensating reference voltage $V_{GREF}$ as the word line voltage to drive the access transistor. Alternatively, the X-DEC 220 can also firstly convent the temperature-compensating reference voltage $V_{GREF}$ to the expected voltage level by the converting circuit such as the operational amplifier or the regulator, and then use the converted voltage as the word line voltage to drive the access transistor.

In this way, according to this embodiment, by comparing the reference voltage $V_{REF}$ with the temperature-dependent voltage $V_{PTAT}$ generated in analog, and selecting either the reference voltage $V_{REF}$ or the temperature-dependent voltage $V_{PTAT}$ based on the comparison result, neither a conventional on-chip temperature sensor nor a logic with a large circuit scale is required, and it would save space in the layout. In addition, in this embodiment, since a conventional DA (digital/analog) converter is not used, it is possible to prevent the accuracy of the reference voltage from suffering due to quantization noise. Furthermore, the voltage-generating circuit can be applied to variable resistance memory, as described above, and it can also be applied to temperature-compensating circuits used in semiconductor devices such as various memory or logic.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A voltage-generating circuit, comprising:

a reference voltage-generating unit, configured to generate a reference voltage essentially without dependency on temperature;

a temperature-dependent voltage-generating unit, configured with positive or negative dependency on temperature, and configured to generate at least one temperature-dependent voltage that is equal to the reference voltage at a target temperature;

a comparison unit, configured to compare the reference voltage with the temperature-dependent voltage; and a selection unit, configured to select the reference voltage during a first condition and select the temperature-dependent voltage during a second condition based on the comparison result of the comparison unit, and output the selected reference voltage or the selected temperature-dependent voltage as a temperature-compensating reference voltage, wherein the first condition and the second condition have different relationships between the target temperature and an operating temperature.

2. The voltage-generating circuit as claimed in claim 1, wherein the selection unit is configured to select the reference voltage when the operating temperature is lower than the target temperature, and to select the temperature-dependent voltage when the operating temperature is higher than the target temperature.

3. The voltage-generating circuit as claimed in claim 1, wherein the selection unit is configured to select the temperature-dependent voltage when the operating temperature is lower than the target temperature, and to select the reference voltage when the operating temperature is higher than the target temperature.

4. The voltage-generating circuit as claimed in claim 1, wherein the selection unit selects the larger one of the reference voltage and the temperature-dependent voltage compared by the comparison unit.

5. The voltage-generating circuit as claimed in claim 1, wherein the selection unit selects the smaller one of the reference voltage and the temperature-dependent voltage compared by the comparison unit.

6. The voltage-generating circuit as claimed in claim 1, wherein the temperature-dependent voltage-generating unit outputs a first temperature-dependent voltage and a second temperature-dependent voltage with different temperature characteristics, the first temperature-dependent voltage is equal to the reference voltage at a first target temperature; and the second temperature-dependent voltage is equal to the reference voltage at a second target temperature;

the comparison unit comprises:

a first comparing circuit, configured to compare the first temperature-dependent voltage with the reference voltage; and a second comparing circuit, configured to compare the second temperature-dependent voltage with the reference voltage;

wherein the selection unit is configured to select the reference voltage during the first condition, select the first temperature-dependent voltage during the second condition, and select the second temperature-dependent voltage during a third condition based on the comparison result of the first comparing circuit and the second comparing circuit.

7. The voltage-generating circuit as claimed in claim 6, wherein the selection unit is configured to select the first temperature-dependent voltage when the operating temperature is lower than the first target temperature; to select the reference voltage when the operating temperature is between the first target temperature and the second target temperature; and to select the second temperature-dependent voltage when the operating temperature is higher than the second target temperature.

8. The voltage-generating circuit as claimed in claim 6, wherein the first temperature-dependent voltage and the second temperature-dependent voltage intersect at an intermediate temperature between the first target temperature and the second target temperature.

9. The voltage-generating circuit as claimed in claim 6, wherein the selection unit is configured to select the reference voltage when the operating temperature is lower than the first target temperature; to select the first temperature-dependent voltage when the operating temperature is between the first target temperature and the intermediate temperature; to select the second temperature-dependent voltage when the operating temperature is between the intermediate temperature and the second target temperature; and to select the reference voltage when the operating temperature is higher than the second target temperature.

10. The voltage-generating circuit as claimed in claim 6, wherein the reference voltage-generating unit generates a first reference voltage and a second reference voltage, the first temperature-dependent voltage is equal to the first reference voltage at a first target temperature, the first temperature-dependent voltage is equal to the second reference voltage at a second target reference voltage at the first target temperature, the second temperature-dependent voltage is equal to the first reference voltage at the second target temperature;

wherein the selection unit is configured to select the first reference voltage when the operating temperature is lower than the first target temperature; to select the first temperature-dependent voltage when the operating temperature is between the first target temperature and the second target temperature; and to select the second reference voltage when the operating temperature is higher than the second target temperature.

11. The voltage-generating circuit as claimed in claim 6, wherein the reference voltage-generating unit generates a first reference voltage and a second reference voltage, the first temperature-dependent voltage is equal to the first reference voltage at a first target temperature, the first temperature-dependent voltage is equal to the second reference voltage at a second target temperature, the second temperature-dependent voltage is equal to the second reference voltage at the first target temperature, the second temperature-dependent voltage is equal to the first reference voltage at the second target temperature;

wherein the selection unit is configured to select the second reference voltage when the operating temperature is lower than the first target temperature; to select the second temperature-dependent voltage when the operating temperature is between the first target temperature and the second target temperature; and to select the first reference voltage when the operating temperature is higher than the second target temperature.

12. The voltage-generating circuit as claimed in claim 1, wherein the reference voltage-generating unit generates a first reference voltage and a second reference voltage, the temperature-dependent voltage is equal to the first reference voltage at a first target temperature, and the temperature-dependent voltage is equal to the second reference voltage at a second target temperature;

wherein the selection unit is configured to select the first reference voltage when the operating temperature is lower than the first target temperature; to select the temperature-dependent voltage when the operating temperature is between the first target temperature and the second target temperature; and to select the second reference voltage when the operating temperature is higher than the second target temperature.

13. The voltage-generating circuit as claimed in claim 1, further comprising:

a converting circuit, receiving the temperature-compensating reference voltage output by the selection unit, and converting a voltage level of the temperature-compensating reference voltage.

14. The voltage-generating circuit as claimed in claim 1, wherein the temperature-dependent voltage-generating unit comprises a DC voltage adjusting unit, to offset a default temperature-dependent voltage generated by the temperature-dependent voltage-generating unit in a positive or negative direction, to generate the temperature-dependent voltage.

15. The voltage-generating circuit as claimed in claim 1, wherein the reference voltage-generating unit comprises a band gap reference circuit.

16. A semiconductor device, comprising:

the voltage-generating circuit as claimed in claim 1; and a driving device, driving a circuit based on the temperature-compensating reference voltage generated by the voltage-generating circuit.

17. The semiconductor device as claimed in claim 16, wherein the driving device comprises a transistor connected to a memory cell;

wherein the driving device applies a first driving voltage based on the reference voltage to a gate of the transistor when the operating temperature is lower than the target temperature; and applies a second driving voltage based on the temperature-dependent voltage to the gate of the transistor when the operating temperature is higher than the target temperature.

18. The semiconductor device as claimed in claim 17, wherein the memory cell comprises:

a variable resistance element; and the transistor connected to the variable resistance element;

wherein the driving device applies the first driving voltage and the second driving voltage to the gate of the transistor through a word line.

19. The semiconductor device as claimed in claim 16, wherein the selection unit is configured to select the temperature-dependent voltage when the operating temperature is lower than the target temperature, and to select the reference voltage when the operating temperature is higher than the target temperature.

20. The semiconductor device as claimed in claim 16, wherein the selection unit selects the larger one of the reference voltage and the temperature-dependent voltage compared by the comparison unit.

* * * * *